US005125510A

United States Patent [19]

Gibson

[11] Patent Number: 5,125,510

[45] Date of Patent: Jun. 30, 1992

[54] END CAPS FOR CONTAINERS

[75] Inventor: Giles M. Gibson, Stevenage, England

[73] Assignee: British Aerospace Public Limited Company, London, United Kingdom

[21] Appl. No.: 495,032

[22] Filed: Mar. 16, 1990

[30] Foreign Application Priority Data

Mar. 17, 1989 [GB] United Kingdom ..... 8906219

[51] Int. Cl.[5] ..... B65D 81/02; F42B 39/26

[52] U.S. Cl. ..... 206/503; 206/3; 206/821

[58] Field of Search ..... 206/3, 503, 821

[56] References Cited

U.S. PATENT DOCUMENTS

| | | | |
|---|---|---|---|
| 2,094,009 | 9/1937 | Goebert | 206/3 |
| 2,127,263 | 8/1938 | Lambert | 206/3 |
| 2,358,915 | 9/1944 | Duthie | 206/3 |
| 2,402,145 | 6/1946 | Belanger | 206/3 |
| 2,661,097 | 12/1953 | Paul | 206/821 |
| 2,722,307 | 11/1955 | Burke et al. | 206/3 |
| 2,766,660 | 10/1956 | Laddon | 206/3 |
| 2,903,124 | 9/1959 | Carver | 206/3 |
| 3,640,018 | 2/1972 | Light | 206/821 |
| 3,840,052 | 10/1974 | Schmidt . | |
| 3,995,749 | 12/1976 | Haskins | 206/84 |
| 4,195,732 | 4/1984 | Bell | 206/821 |
| 4,354,599 | 10/1982 | Brown | 206/821 |
| 4,420,093 | 12/1983 | Von Holdt . | |
| 4,733,773 | 3/1988 | LeBianca et al. | 206/3 |
| 4,785,930 | 11/1988 | Fischer | 206/3 |
| 4,838,419 | 6/1989 | Weits et al. | 206/821 |
| 4,862,871 | 9/1989 | Sieberth | 206/821 |

FOREIGN PATENT DOCUMENTS

| | | | |
|---|---|---|---|
| 0182416 | 5/1986 | European Pat. Off. . | |
| 1082756 | 1/1955 | France | 206/3 |
| 1162345 | 9/1958 | France . | |
| 1477295 | 4/1967 | France . | |
| 101522 | 8/1980 | Japan | 206/821 |
| 1477798 | 6/1977 | United Kingdom . | |
| 1488764 | 10/1977 | United Kingdom . | |
| 1597711 | 9/1981 | United Kingdom . | |
| 2092720 | 8/1982 | United Kingdom . | |
| 2195169 | 3/1988 | United Kingdom . | |

*Primary Examiner*—Stephen Marcus
*Attorney, Agent, or Firm*—Cushman, Darby & Cushman

[57] ABSTRACT

It is known for munition rounds to be packaged in canisters with shock absorbing end caps shaped to resist rolling movement of the canisters. Described herein are end caps which, as well as being connectible to the ends of the canisters, have recesses so that the end caps, having been removed from the canisters, can do double duty engaged between the sides of the canisters to support and space the canisters in a stack formation. The idea is also applicable to packaging for materials and objects other than munitions.

7 Claims, 2 Drawing Sheets

END CAPS FOR CONTAINERS

This invention relates to end caps for containers, especially but not exclusively for elongate cylindrical containers containing munition rounds.

Munition rounds, for example mortar bombs, artillery shells, rockets and the like may be packaged in canisters to the ends of which are fitted resilient end caps. These caps are shaped to prevent the usually round canisters from rolling and they absorb shock (say in the event of a package being dropped).

For compact storage, or for rendering a supply of many munition rounds tidy and easily to hand at a firing position, it is often required that the canisters be laid row upon row to form a stack. Such a stack may not be self-supporting. Also, desirably, the canisters should be spaced apart in the stack so that the round stored in any one container can be more easily retrieved.

The object of the invention is to provide a convenient and inexpensive supply of stack supporting and container spacing members and, in accordance with the invention, this is done by providing end-caps for the containers which can perform the role of support/spacing members, preferably still being effective when fitted to the container ends to give the normal shock absorbing and roll preventing functions.

Thus, according to one aspect of the invention, there is provided an end cap for a container, the end cap comprising an engagement portion for attaching the end cap to the container and having recesses for being engaged between two of said containers to support them spaced one from the other.

Advantageously said engagement portion comprises a wall defining an aperture for fitment over an end of said container.

The end cap may be of resilient material to absorb shock applied to the end of the container.

Preferably said recesses include a first recess for engaging the side of a first container and two further recesses for engaging the sides of respective ones of two more containers adjacent the first so as to support the said containers in a stack formation.

Advantageously said recesses are part-circular in cross-section.

The end cap may comprise side portions extending out from the sides of the container when the end cap is attached to the container, these side portions being operable for limiting any tendency for the container to roll, for example said side portions may together define a polygonal cross-sectional shape of the end cap.

According to a second aspect of the invention, there is provided a package comprising a container and two end caps, each as described above aand each being operable for being attached to a respective one of two opposite ends of the container, which container may be elongate and cylindrical.

According to a third aspect of the invention, there is provided a package as described above and a munition round contained within said container.

Figure 1:
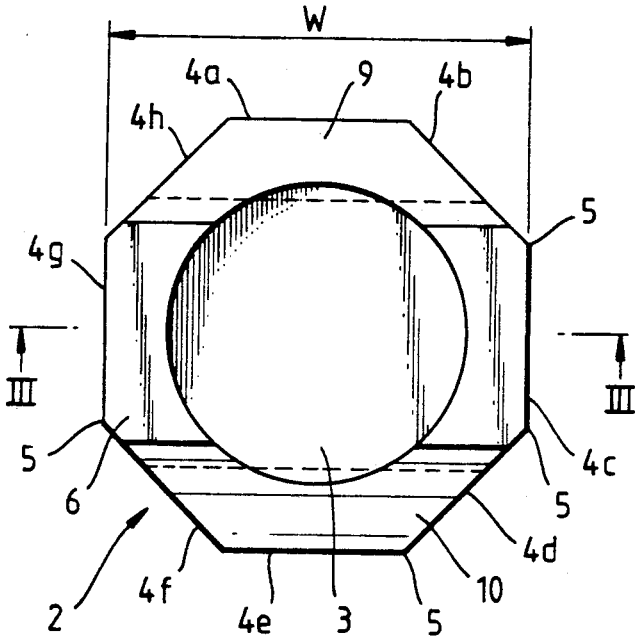
Figure 2:
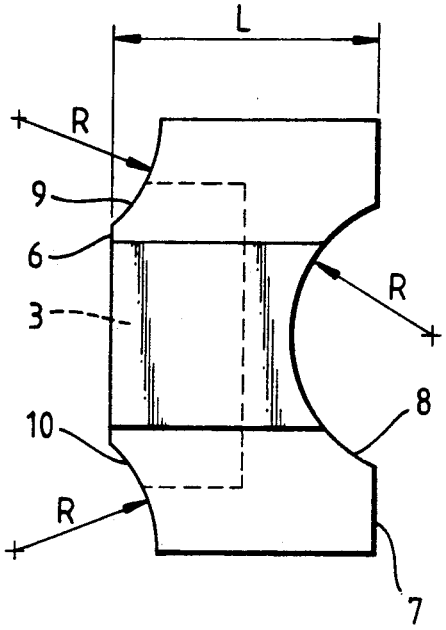
Figure 3:
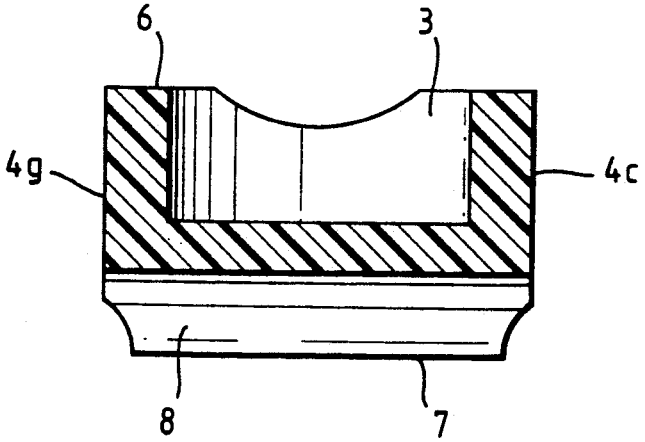
Figure 4:
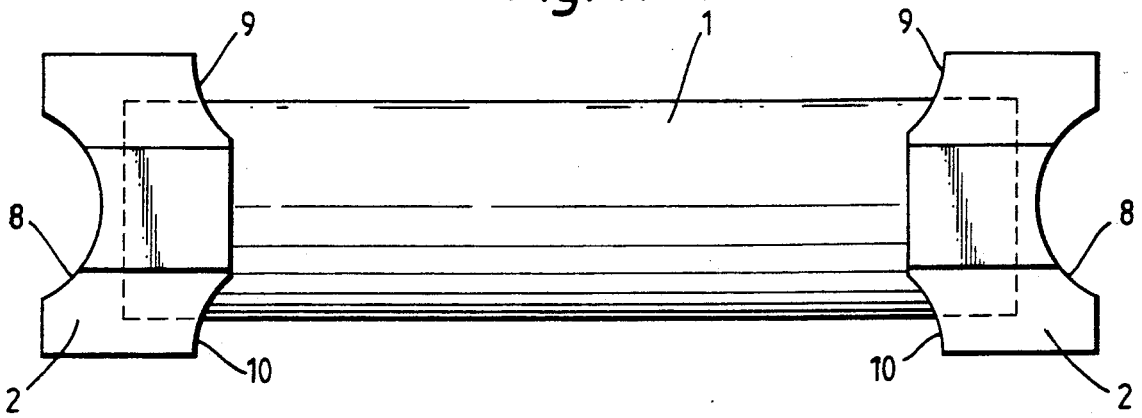
Figure 5:
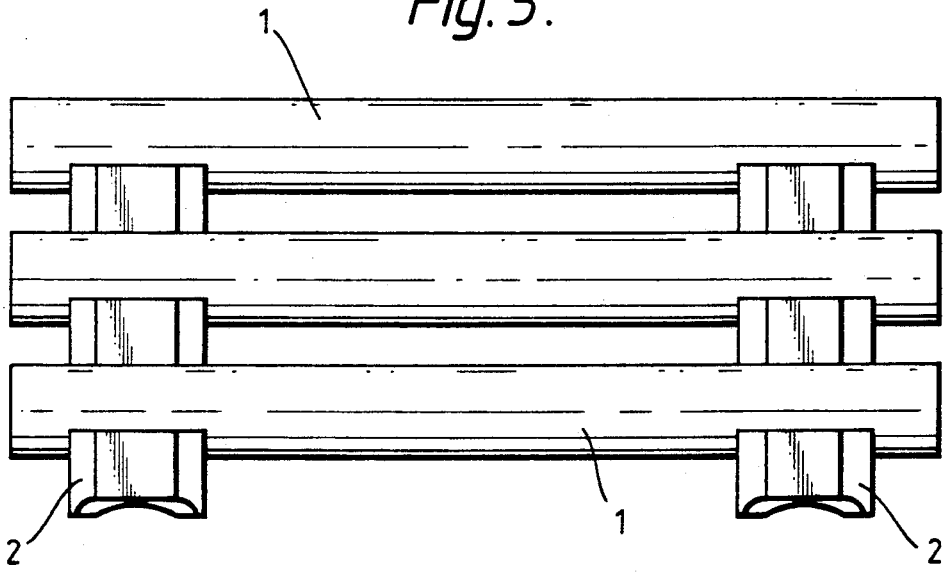
Figure 6:
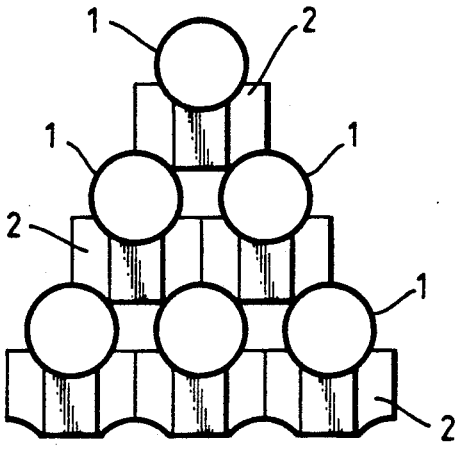

For a better understanding of the invention, reference will be made, by way of example, to the accompanying drawings, in which:

FIG. 1 is an end view of an end-cap for forming part of a projectile package, FIG. 2 is a side view corresponding to FIG. 1, FIG. 3 is a section on line III III of FIG. 1, FIG. 4 is a side view of the projectile package, and FIGS. 5 and 6 are a side and an end view respectively of a stack of several projectile packages.

The projectiles referred to herein may comprise mortar bombs, artillery shells, rocket propelled missiles and the like. Each round, i.e. each single projectile, is supplied and stored fitted inside a package which comprises an elongate cylindrical canister 1 to each end of which there is fitted an end-cap 2 made of material firm enough to support the canister but having a degree of resilient flexibility sufficient to provide an effective shock absorbing effect should the package, and its contents, be dropped end on to the ground. As an example, the end caps might be made of expanded polyethylene having a density of around fifty kilograms per cubic metre. A suitable material is available under the tradename "Plastazote". The end-caps 2 do not necessarily have the function of closing the ends of the canister 1—rather the canister can take the form of closed ended "tin can" with a rip-strip (not shown) near one end as disclosed in European Patent Specification No. 251451 so that the canister can be opened and its contents removed when required or possibly the canister could have screw-on end closures or the like.

As shown best in FIGS. 1 to 3, each end cap comprises a one piece member made from the aforementioned "Plastazote" material, for example by moulding the material, or by cutting a block of the material to shape, preferably by a heat fusion process such as hot-wire cutting. After cutting, it is preferred that the surfaces of the end cap be heat sealed.

In end view (FIG. 1) the end cap has the shape of a regular octagon which, from side to opposite side and from corner to corner, is wider than the canister 1 so that, when the end caps are in place and the package is laid down on a horizontal surface, the canister would always be supported above that surface and further, because of the octagonal shape, the package would tend not to roll round much if knocked or if the surface were sloping rather than horizontal. In the illustrated example, the width W from each side to the opposite side of the end cap is just greater than one and a half times the diameter of the canister, say 1.6 times that diameter.

A cylindrical recess 3 extends, parallel to the sides 4*a* to 4*h* and the corners 5 of the octagonal shape, from one end face 6 of the cap in to about half way through towards the opposite end face 7. The recess 3 is sized to provide a frictional fit on the end of canister 1 and to fit the end cap to the canister, the cap is simply pushed onto the end of the canister so that the recess is engaged around that end. The length L of the end cap 2 from end face 6 to end face 7, is about equal to the diameter of the canister 1.

Extending across the middle of the end face 7 of the end cap, parallel to two opposite sides 4*a* and 4*e* of the end cap, there is a recess 8 which is part-circular in cross-section and which has a radius R equal to that of the canister 1, the radius being centred in a plane containing the central axis of recess 3 at a distance from end face 7 of about two fifths of the radius R.

In addition, the edge regions between the end face 6 and respective ones of the sides 4*a* and 4*e* are each inwardly recessed to define respective surfaces 9 and 10. Like the recess 8, each of the surfaces 9 and 10 is part circular in cross-section with a radius R equal to that of the canister 1. The radius of surface 9 is centred in the plane containing side 4*a* of the end cap at a distance from end face 6 of about three fifths of the radius. Meanwhile, the radius of surface 10 has its centre at the same distance from end face 6 but in the plane containing side 4*e*.

The function of the recess 8 and surfaces 9 and 10 is to permit the end caps to be used as spacer/stack forming supports as shown in FIGS. 5 and 6. To form this stack, the two end caps from a canister which is to be in the lowest layer of the stack are removed from the ends of the canister and laid down with the recesses 8 uppermost and aligned one with the other so that the canister can be cradled in the two recesses. The end caps from the next lowest layer canister are similarly laid down, closely adjacent or touching respective ones of the first two end caps, and the associated canister laid in the cradle so formed. The remainder of the lowest layer of the stack is formed in a similar manner. For the remaining layers of the stack, the end caps from each canister are laid so that the surfaces 9 and 10 of each cap lie on and between two adjacent canisters in the next lower layer, the recesses 8 of these end caps again being uppermost and forming a cradle for the associated canister as before.

The result is a well supported, stable stack of the canisters with each canister well spaced from those around it so that, if the canisters are open ended, or have already been opened, rounds can be easily reached and removed from the stack one by one. If the canisters are still closed, then it may well be preferred to take them one by one from the top of the stack, open them and remove the round and then just discard them. Being relatively light in weight, the presence of the end caps in their role of spacer/stack formers form little impediment to such progressive dismantling of the stack.

As will be appreciated, the dimensions of the end caps may be varied according to the dimensions of the canisters. Also for a given diameter of the canister, the relative dimensions of the end caps can be varied from the exemplary values described and illustrated herein, for example the length L could be changed to give a different relative spacing of the stacked canisters. Instead of being octogonal, the end caps could have a different cross-sectional shape, say hexagonal, perhaps to allow for some particular requirement of the storage environment or the like. The recesses 8 and surfaces 9 and 10 need not be circular in cross-section but would be effective for the function described if they were say V-shaped or part rectangular. It is possible also that these recesses and surfaces could be provided in the sides rather than the end faces of the cap so that, to form the stack, the end caps are laid with their end faces upright rather than horizontal—however, if the width W of the end cap is greater than the length L, it follows that for a given value of L the arrangement illustrated gives the best stack stability and is hence preferred. Finally, as will be well appreciated, it is not necessarily munition rounds which are stored in the canisters 1—rather the invention is applicable in the case of any objects or material which are supplied and stored in a relevant manner.

I claim:

1. An end cap for a container of the type having first and second end faces and cylindrical sidewalls, comprising a main body portion having:

a first longitudinal end, a second longitudinal end, and a longitudinal axis, a container end receiving recess defined in the first end of said main body portion, said container end receiving recess being circular in cross-section and having a longitudinal axis coincident with said longitudinal axis of said main body;

a first part cylindrical recess defined on the second end of said main body portion, a central axis of said first part cylindrical recess intersecting and being substantially perpendicular to said longitudinal axis of said main body portion;

second and third part cylindrical recesses, said second part cylindrical recesses being defined on said first end of said main body portion, a central axis of each of said second and third part cylindrical recesses being parallel to said central axis of said first part cylindrical cut-out or recess and spaced from said longitudinal axis of said main body portion, whereby said main body portion can be selectively mounted on an end of a container by inserting the end of the container into the container end receiving recess and, alternatively, mounted as a spacer between three parallel, side-by-side containers with one of the part cylindrical recesses engaging a portion of the cylindrical wall of a respective container.

2. An end cap according to claim 1 made of resilient material to absorb shock applied to said one end face.

3. An end cap according to claim 1 in which said first, second and third recesses are part circular in cross-section.

4. An end cap according to claim 1 and further comprising side portions extending outward from the body portion of the first container when said end cap is attached to the first container, said side portions being operable for limiting any tendency for the first container to roll.

5. An end cap according to claim 4 in which said side portions together define a polygonal cross-sectional shape of said end cap.

6. A package comprising three containers, each container having two end faces and an intermediate cylindrical body portion, and two end caps, each said end cap comprising a main body having:

a) a cylindrical recess sized and shaped so as to be selectively mountable over a said end face;

b) a first part cylindrical recess engaging the cylindrical body portion of a first of the containers intermediate the end faces thereof; and c) second and third part cylindrical recesses engaging cylindrical body portions of the other two containers intermediate the end faces thereof, the three containers being disposed adjacent and parallel to one another so that said two end caps support the three containers in a stack formation.

7. A package according to claim 6, in further combination with a munition round contained within said containers.

* * * * *